US011286126B2

(12) United States Patent
Yamaguchi et al.

(10) Patent No.: US 11,286,126 B2
(45) Date of Patent: Mar. 29, 2022

(54) SHEET CONVEYER AND IMAGE RECORDING APPARATUS

(71) Applicant: Brother Kogyo Kabushiki Kaisha, Nagoya (JP)

(72) Inventors: Masatomo Yamaguchi, Inazawa (JP); Hirotaka Aoki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 221 days.

(21) Appl. No.: 16/555,606

(22) Filed: Aug. 29, 2019

(65) Prior Publication Data

US 2020/0071101 A1 Mar. 5, 2020

(30) Foreign Application Priority Data

Aug. 31, 2018 (JP) ..... JP2018-163518
Aug. 31, 2018 (JP) ..... JP2018-163881

(51) Int. Cl.
*B65H 5/06* (2006.01)

(52) U.S. Cl.
CPC ..... *B65H 5/068* (2013.01); *B65H 2404/144* (2013.01); *B65H 2601/11* (2013.01); *B65H 2601/32* (2013.01)

(58) Field of Classification Search
CPC ..... B65H 2404/144; B65H 2601/11; B65H 2402/45; B65H 5/068
See application file for complete search history.

(56) References Cited

U.S. PATENT DOCUMENTS

2010/0098473 A1* 4/2010 Hosoi ..... G03G 21/1642 399/400
2015/0084272 A1* 3/2015 Maruyama ..... G03G 15/6514 271/226
2017/0343955 A1* 11/2017 Shiga ..... G03G 15/6529

FOREIGN PATENT DOCUMENTS

JP H07-125868 A 5/1995
JP 2011-157173 A 8/2011
JP 5633151 B2 12/2014

* cited by examiner

*Primary Examiner* — Howard J Sanders
(74) *Attorney, Agent, or Firm* — Banner & Witcoff, Ltd.

(57) ABSTRACT

A sheet conveyer, including a body with a conveyer path, a first roller, a second roller, a roller holder supporting the second roller rotatably, an urging member urging the roller holder, and a guide member, is provided. The guide member is supported rotatably by the body at a position on a side opposite to the first roller across the second roller is pivotable between a closed position and an open position. The roller holder is movable between a first position, where the second roller contacts the first roller, and a second position, where the second roller is separated from the first roller and in which the roller holder contacts the guide member located at the open position. The roller holder located at the second position is restricted by the guide member from moving farther from the first position. The urging member urges the roller holder toward the first position.

22 Claims, 9 Drawing Sheets

SHEET CONVEYER AND IMAGE RECORDING APPARATUS

CROSS REFERENCE TO RELATED APPLICATION

This application claims priority from Japanese Patent Applications No. 2018-163518 and No. 2018-163881, both filed on Aug. 31, 2018, the entire subject matters of which are incorporated herein by reference.

BACKGROUND

Technical Field

An aspect of the present disclosure is related to a sheet conveyer for conveying a sheet and to an image recording apparatus with the sheet conveyer for recording images on the sheet.

Related Art

A sheet conveyer may include paired rollers to convey a sheet along a conveyer path. One of the paired rollers may be urged against the other of the paired rollers by an urging member such as a spring. The paired rollers may nip the sheet in there-between and rotate to covey the sheet.

The sheet conveyer may further have a guide member that forms a part of the conveyer path. The guide member may guide the sheet in the conveyer path. The guide member may be movable between a closed position, in which the guide member forms the conveyer path, and an open position, in which the conveyer path is exposed to the outside. The guide member may be moved to the open position, when, for example, the sheet is jammed in the conveyer path, so that the jammed sheet may be removed from the conveyer path. In this occasion, the paired rollers may be moved to separate from each other so that the sheet may be released from the paired rollers and removed more easily.

In this regard, for example, a sheet conveyer, in which the paired rollers may move to separate from each other in conjunction with a movement of the guide member moving from the closed position to the open position, is suggested.

For another example, a sheet conveyer with the guide member pivotable between the closed position to the open position, in which the paired rollers may be moved manually to separate from each other by a user once the guide member is moved to pivot from the closed position to the open position, is suggested.

SUMMARY

In the sheet conveyer of the former example, when the guide member moves from the closed position to the open position, the paired rollers are always separated from each other while the rollers may not always need to be separated. Each time when the paired rollers are moved to separate from each other, the force to separate the paired rollers from each other may affect the urging member that urges the one of the paired rollers against the other. Thus, the urging member may be abraded, or the resiliency of the urging member may be lowered, and the urging member may be fatigued in a short period of time. In order to restrain the urging member from being fatigued, it may be desirable that the separation of the rollers is restrained as infrequently as possible.

Moreover, in the former sheet conveyer, a movable amount of the one of the rollers to move closer to and farther from the other may be restricted by an aperture formed in a frame. In particular, a shaft of the one of the rollers may be movable within a length of the aperture. In this regard, however, forming the aperture in the frame and extending the shaft of the roller to reach the frame may complicate the structure in the conveyer and may require a larger space for the sheet conveyer.

Meanwhile, in sheet conveyer of the latter example, the rollers may be moved manually, which may be regarded by the user unhandy.

The present disclosure is advantageous in that a sheet conveyer, in which separation of a roller in paired rollers may be restrained to a minimum frequency, and a movable amount of the roller to be separated from the other roller in the paired rollers may be restricted in a less complicated structure, is provided. Moreover, in the sheet conveyer, the fatiguing effect on the urging member that urges the one of the paired rollers against the other may be reduced, and a jammed sheet may be easily removed.

According to an aspect of the present disclosure, a sheet conveyer, including a body having a conveyer path, in which a sheet is conveyable, a first roller located in the conveyer path, a second roller located to face the first roller, a roller holder configured to support the second roller rotatably, an urging member configured to urge the roller holder, and a guide member supported rotatably by the body at a position on a side opposite to the first roller across the second roller, is provided. The guide member is pivotable between a closed position, in which the guide member forms the conveyer path, and an open position, in which the conveyer path and the roller holder are exposed outward. The roller holder is movable between a first position, in which the second roller contacts the first roller, and a second position, in which the second roller is separated from the first roller and in which the roller holder contacts the guide member located at the open position. The roller holder located at the second position is restricted by the guide member from moving farther from the first position. The urging member is configured to urge the roller holder toward the first position.

According to an aspect of the present disclosure, an image recording apparatus, including a sheet conveyer and a recorder is provided. The sheet conveyer includes a body having a conveyer path, in which a sheet is conveyable, a first roller located in the conveyer path, a second roller located to face the first roller, a roller holder configured to support the second roller rotatably, an urging member configured to urge the roller holder, and a guide member supported rotatably by the body at a position on a side opposite to the first roller across the second roller. The guide member is pivotable between a closed position, in which the guide member forms the conveyer path, and an open position, in which the conveyer path and the roller holder are exposed outward. The recorder is configured to record an image on the sheet being conveyed in the conveyer path. The roller holder is movable between a first position, in which the second roller contacts the first roller, and a second position, in which the second roller is separated from the first roller and in which the roller holder contacts the guide member located at the open position. The roller holder located at the second position is restricted by the guide member from moving farther from the first position. The urging member is configured to urge the roller holder toward the first position.

According to an aspect of the present disclosure, a sheet conveyer, including a body having a conveyer path, in which a sheet is conveyable, a first roller located in the conveyer path, a second roller located to face the first roller, a roller holder configured to support the second roller rotatably and to be pivotable between a first position, in which the second roller contacts the first roller, and a second position, in which the second roller is separated from the first roller, an urging member configured to urge the roller holder toward the first position, and a first guide member pivotably supported by the body independently from the roller holder at a position on a side opposite to the first roller across the second roller. The first guide member is pivotable between a closed position, in which the first guide member closes the body and forms a part of the conveyer path, and an open position, in which the first guide member opens the body and exposes the conveyer path and the roller holder outward. The roller holder includes a guide portion forming another part of the conveyer path at a position downstream from the second roller in a conveying direction to convey the sheet.

According to an aspect of the present disclosure, an image recording apparatus, including a sheet conveyer and a recorder is provided. The sheet conveyer includes a body having a conveyer path, in which a sheet is conveyable, a first roller located in the conveyer path, a second roller located to face the first roller, a roller holder configured to support the second roller rotatably and to be pivotable between a first position, in which the second roller contacts the first roller, and a second position, in which the second roller is separated from the first roller, an urging member configured to urge the roller holder toward the first position, and a guide member pivotably supported by the body independently from the roller holder at a position on a side opposite to the first roller across the second roller. The first guide member is pivotable between a closed position, in which the first guide member closes the body and forms a part of the conveyer path, and an open position, in which the first guide member opens the body and exposes the conveyer path and the roller holder. The recorder is configured to record an image on the sheet being conveyed in the conveyer path. The roller holder includes a guide portion forming another part of the conveyer path at a position downstream from the second roller in a conveying direction to convey the sheet.

BRIEF DESCRIPTION OF THE ACCOMPANYING DRAWINGS

DETAILED DESCRIPTION

Figure 1:
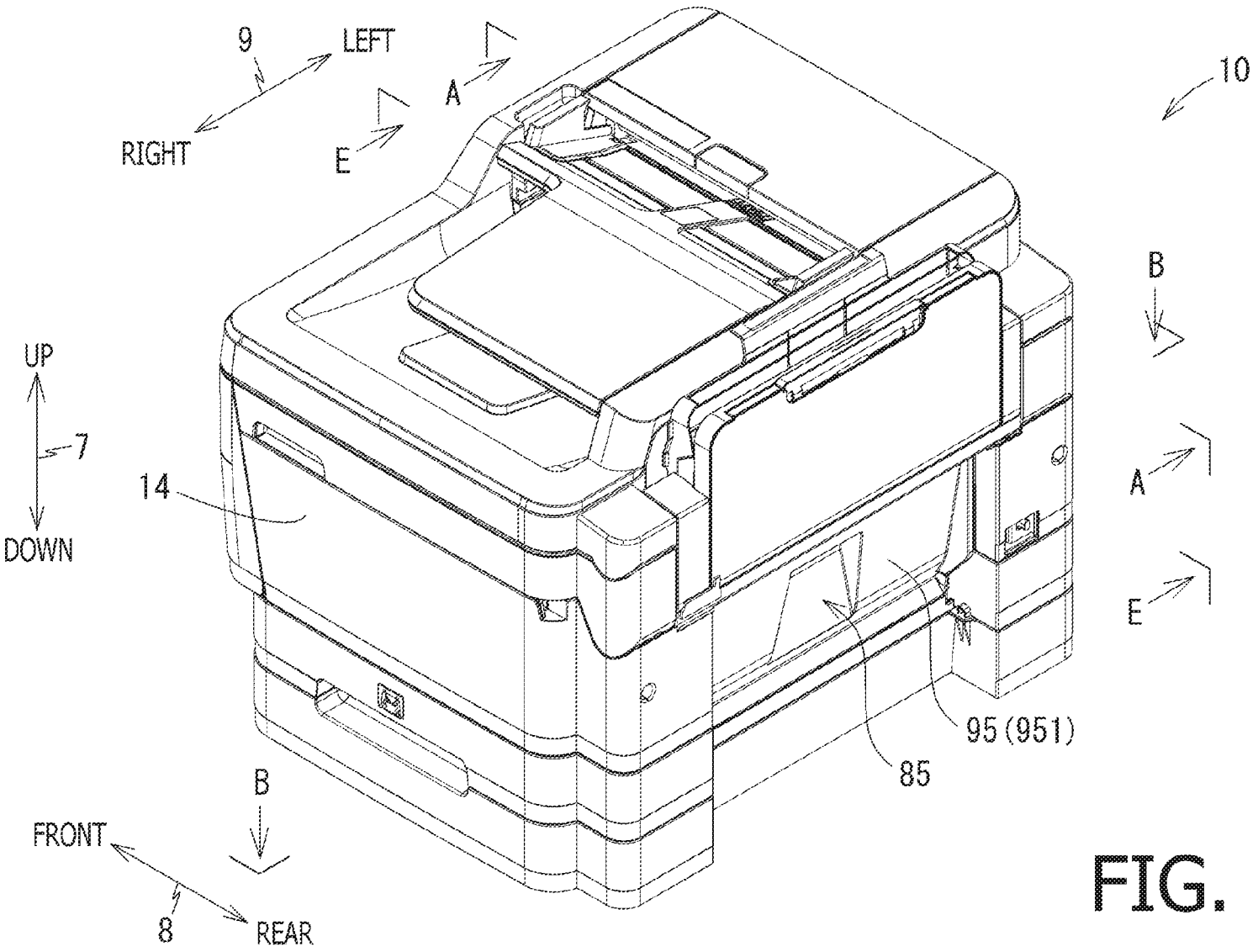
FIG. 1 is a perspective view of a multifunction peripheral (MFP) 10 according to an embodiment of the present disclosure with a guide member 85 at a closed position.

In the following paragraphs, described with reference to the accompanying drawings will be an embodiment of the present disclosure. It is noted that various connections may be set forth between elements in the following description. These connections in general and, unless specified otherwise, may be direct or indirect and that this specification is not intended to be limiting in this respect. It will be understood that those skilled in the art will appreciate that there are numerous variations and permutations of a sheet conveyer and an image recording apparatus that fall within the spirit and scope of the invention.

In the following description, positional relation within the MFP 10 and each part or item included in the MFP 10 will be mentioned on basis of the orientation of the MFP 10 in an operable condition as indicated by the bi-directionally pointing arrows in each drawing. For example, in FIG. 1, a vertical axis between an upper side and a lower side in the drawing is defined as an up-down direction 7. While a side, on which a guide member 85 arranged, is defined as a rear side, an axis between the rear side and a front side opposite from the rear side is defined as a front-rear direction 8. A right-hand side and a left-hand side to a user who faces the front side of the MFP 10 are defined as a rightward side and a leftward side, respectively. Further, an axis between the right-hand side and the left-hand side is defined as a right-left direction 9. The up-down direction 7, the front-rear direction 8, and the right-left direction 9 intersect orthogonally to one another. In the present embodiment, the up-down direction 7 and the right-left direction 9 may be referred to as a vertical direction 7 and a widthwise direction 9, respectively. The front-rear direction 8 and the widthwise direction 9 coincide with a horizontal direction.

Overall Configuration of the MFP 10

As shown in FIG. 1, the MFP 10 has an approximately rectangular-boxed shape and has multiple functions, including a facsimile transmission function and a printing function. In particular, the MFP 10 has a printing function to record an image on a sheet.

Figure 2:
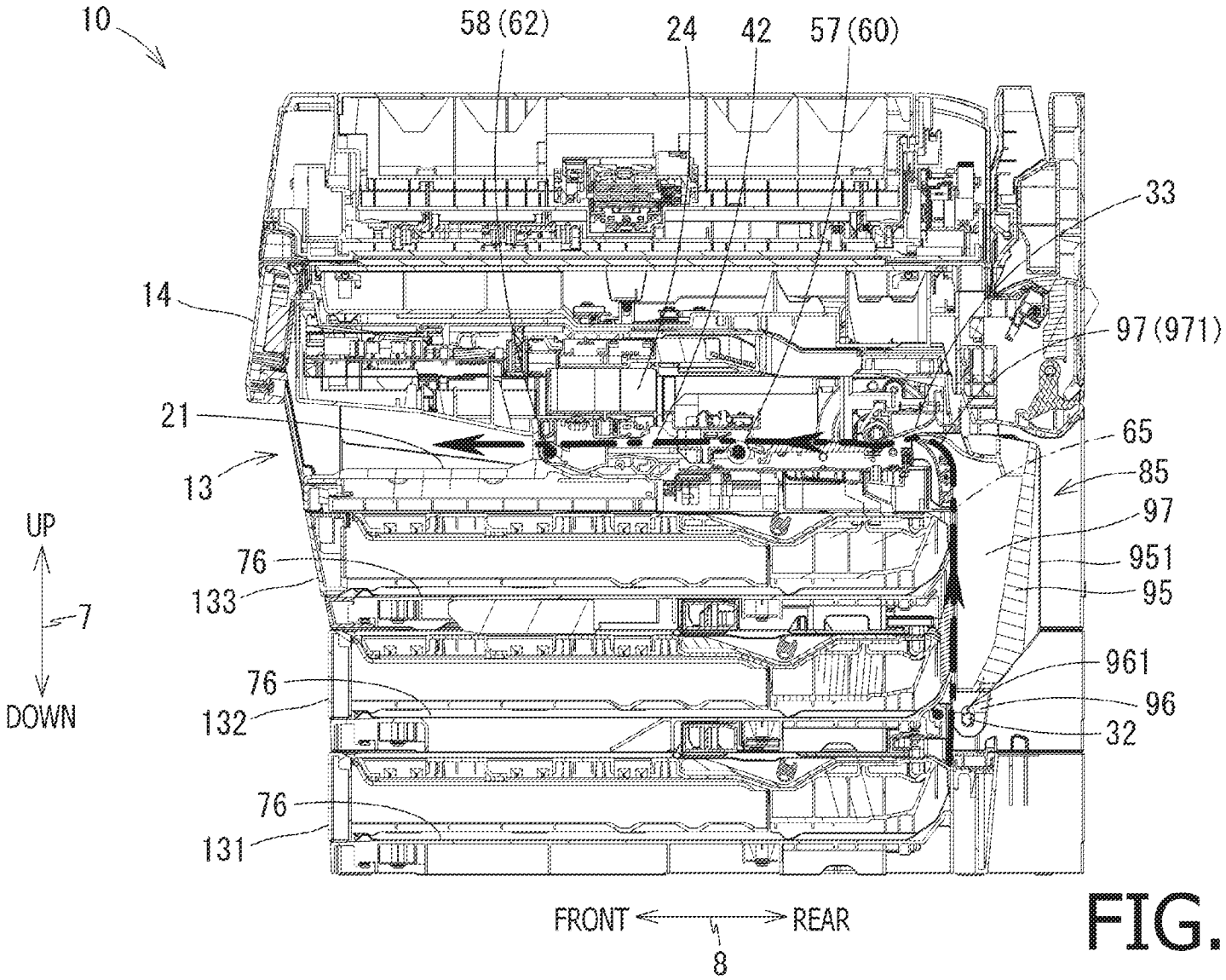
FIG. 2 is a cross-sectional view of the MFP 10 according to the embodiment of the present disclosure viewed at a section A-A shown in FIG. 1.

As shown in FIG. 2, the MFP 10 includes a sheet conveyer and a recorder 24. The sheet conveyer includes a housing 14, feeder trays 131, 132, 133, an ejection tray 21, a feeder 141 (see FIG. 4), a guide member 71 (see FIG. 5), a conveyer roller pair 57, a discharge roller pair 58, an intermediate roller pair 86 (see FIG. 5), a torsion coil spring 88 (see FIG. 5), a roller holder 87 (see FIG. 5), and a guide member 85.

The hosing 14, as shown in FIG. 1, forms an exterior shell of the MFP 10. As shown in FIG. 2, on a front side of the hosing 14, formed is an opening 13. The recorder 24, the feeder 141, the guide member 71, the conveyer roller pair 57, the discharge roller pair 58, the intermediate roller pair 86, the torsion coil spring 88, and the roller holder 87 are arranged inside the housing 14. Inside the housing 14, formed is a conveyer path 65, in which a sheet may be conveyed. The conveyer path 65 is indicated in a dash-and-dot line in FIG. 2.

The feeder trays 131, 132, 133 may be inserted toward the rear side in the housing 14 through the opening 13 to be attached to the housing 14 and may be pulled frontward to be removed from the housing 14 through the opening 13. The ejection tray 21 is supported by the feeder tray 133. The guide member 85 is supported pivotably by the housing 14 (see FIGS. 1 and 3).

The feeder trays 131, 132, 133 each has a form of an approximately rectangular top-open box. Each of the feeder trays 131, 132, 133 includes a bottom plate 76, on which a sheet or sheets in stack may be supported.

When the feeder trays 131, 132, 133 are attached to the housing 14, the feeder tray 133 is located above the feeder tray 132, and the feeder tray 132 is located above the feeder tray 131.

The feeder 141 includes a plurality of feeders 141, 141, 141, which are provided to serve in correspondence with the feeder trays 131, 132, 133, respectively. The feeder 141 shown in FIG. 4 corresponds to the feeder tray 133 among the feeder trays 131, 132, 133. The feeder 141 is located above the bottom plate 76 in each of the feeder trays 131, 132, 133. Each feeder 141 may feed the sheet set on upper surface of the bottom plate 76 in the feeder tray 131, 132, or 133 to the conveyer path 65, which is located rearward. In other words, the feeders 141 may feed the sheets on the bottom plates 76 to convey rearward.

Figure 4:
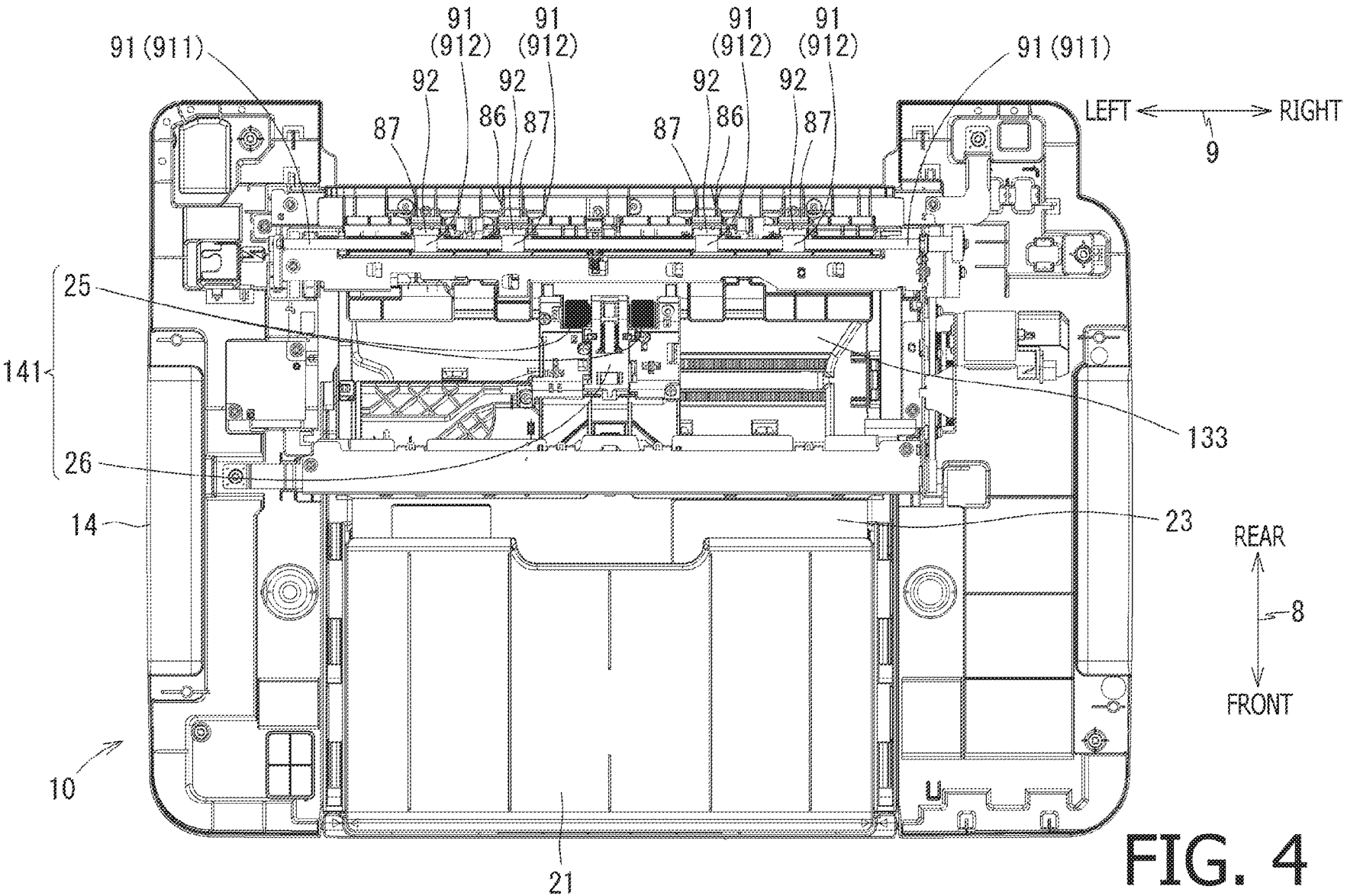
FIG. 4 is a cross-sectional view of the MFP 10 according to the embodiment of the present disclosure viewed at a section B-B shown in FIG. 1.

The feeders 141 corresponding to the feeder trays 131, 132, 133 are in a same structure; therefore, in the following paragraphs, solely one of the feeders 141, which is shown in FIG. 4, corresponding to the feeder tray 133, will be described representatively. The feeder 141 includes, as shown in FIG. 4, a feed roller 25, an arm 26, and a shaft (not shown).

The feed roller 25 is supported by the arm 26 rotatably at a tip end of the arm 26 and may rotate by a driving force from a motor (not shown). The arm 26 is supported at a basal end thereof by the shaft pivotably. The shaft is supported by a frame 23 of the MFP 10. The arm 26 is pivotable may be urged toward the bottom plate 76 by the effect of gravity or by a resilient force of, for example, a spring (not shown). The feed roller 25 may be placed to contact an uppermost sheet in the sheet stack on the bottom plate 76 and rotate to pick up the uppermost sheet to feed to the conveyer path 65.

The sheet fed in the conveyer path 65 may be conveyed in a conveying direction 16, which is indicated by the dash-and-dot line with the arrow as shown in FIG. 2, in the conveyer path 65. When a downstream end of the sheet in the conveying direction 16 reaches the conveyer roller pair 57 in the conveyer path 65, the sheet may be conveyed in the conveying direction 16 by the conveyer roller pair 57 toward the recorder 24. When the sheet reaches a position straight below the recorder 24, the recorder 24 may record an image on the sheet.

Figure 5:
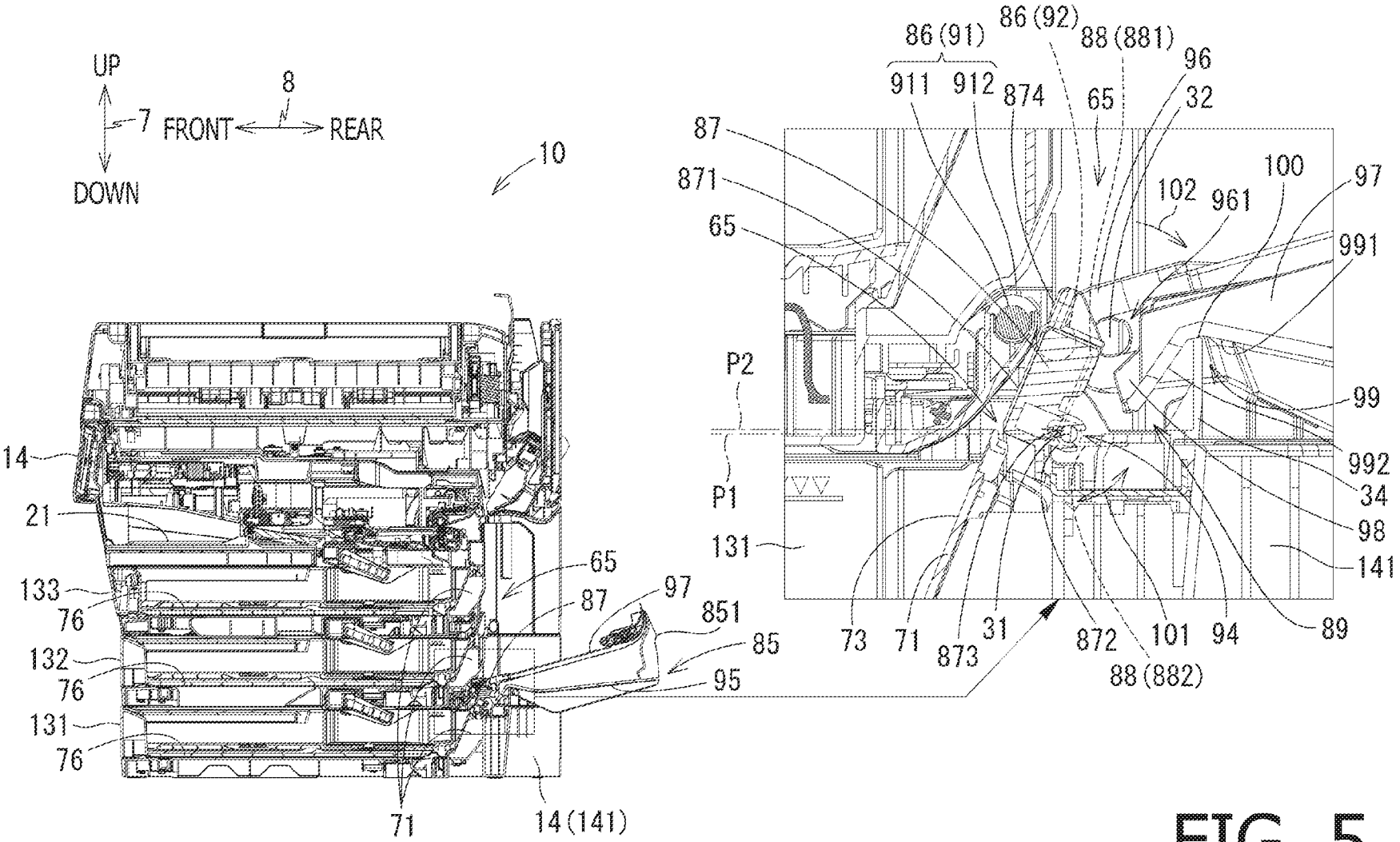
FIG. 5 is a cross-sectional view of the MFP 10 according to the embodiment of the present disclosure viewed at a section C-C shown in FIG. 3 with a roller holder 87 at a first position.

The guide member 71 includes a plurality of guide members 71, 71, 71. As shown in FIG. 5, the guide members 71, 71, 71 are located rearward with respect to the feeder trays 131, 132, 133, respectively. In other words, the guide members 71, 71, 71 are arranged at positions downstream from the feeder trays 131, 132, 133, respectively, in the conveying direction 16. The guide members 71, 71, 71 corresponding to the feeder trays 131, 132, 133 are in a same structure; therefore, in the following paragraphs, solely one of the guide members 71, 71, 71 corresponding to the feeder tray 131 may be described representatively.

The guide member 71 has an oblique surface 73 that faces obliquely upper-frontward. The oblique surface 73 inclines with respect to the upper surface of the bottom plate 76 to lean rearward to be higher and frontward to be lower. A lower end of the oblique surface 73 is located in adjacent to a rear end of the feeder tray 131 attached to the housing 14. The sheet being conveyed rearward by the feed roller 25 may contact the oblique surface 73 and may be guided along the oblique surface 73 to orient upward in the conveyer path 65 toward a position between a first roller 91 and a second roller 92 in the intermediate roller pair 86.

As shown in FIG. 2, the conveyer path 65 extends upward from the rear end of the feeder tray 131 along a rearward surface of the guide member 71 corresponding to the feeder tray 132 to reach a rearward surface of the guide member 71 corresponding to the feeder tray 133. The conveyer path 65 bends frontward at an upper position with respect to the rearward surface of the guide member 71 corresponding to the feeder tray 133. The conveyer path 65 further extends frontward from the bending position through the conveyer roller pair 57, the recorder 24, and the discharge roller pair 58 to an upper position with respect to the ejection tray 21. In other words, the conveyer path 65 includes a part extending upward and a part extending frontward at a downstream position with respect to the upward-extending part in the conveying direction 16.

The conveyer roller pair 57 includes a conveyer roller 60 and a pinch roller (not shown), which face each other. The conveyer roller 60 may rotate by a driving force from a motor (not shown). The motor to drive the conveyer roller 60 may or may not be the same motor as the motor that drives the feed roller 25. The pinch roller may be rotated alongside the rotation of the conveyer roller 60. The conveyer roller pair 57 may pinch the sheet and convey the sheet in the conveying direction 16.

The ejection roller pair 58 is located at a position downstream from the conveyer roller pair 57 in the conveying direction 16 in the conveyer path 65. The ejection roller pair 58 includes an ejection roller 62 and a spur (not shown), which face each other. The ejection roller 62 may rotate by a driving force from a motor (not shown). The motor to drive the ejection roller 62 may or may not be the same motor as the motor(s) that drives the feed roller 25 and the conveyer roller 60. The spur may be rotated alongside the rotation of the ejection roller 62. The ejection roller pair 58 may pinch the sheet and convey the sheet in the conveying direction 16. The sheet conveyed by the ejection roller 58 in the conveying direction 16 may be ejected to rest on the ejection tray 21.

The recorder 24 is located between the conveyer roller pair 57 and the ejection roller pair 58 in the conveyer path 65. The recorder 24 may be an inkjet recording device that may record an image on the sheet conveyed in the conveyer path 65. However, the recorder 24 may not necessarily be limited to the inkjet recording device but may be a recorder that may record an image, for example, electro-photographically.

Intermediate Roller Pair 86

As shown in FIG. 5, the intermediate roller pair 86 is located at an upper position with respect to an upper end of the guide member 71 that corresponds to the feeder tray 131 and at a lower position with respect to an upper end of the guide member 71 that corresponds to the feeder tray 132. The intermediate roller pair 86 may nip and convey the sheet in the conveying direction 16.

The intermediate roller pair 86 includes the first roller 91 and the second roller 92, which face each other. The first roller 91 and the second roller 92 are located upper positions with respect to the oblique surface 73 of the guide member 71.

As shown in FIG. 4, the first roller 91 includes a shaft 911 and a roller body 912. The shaft 911 extends in the widthwise direction 9. The roller body 912 circles around an outer periphery of the shaft 911. The roller body 912 may include a plurality of, e.g., four (4), roller bodies 912, 912, 912, 912, which are arranged to be spaced apart from one another along the widthwise direction 9. However, the quantity of the roller bodies 912 may not necessarily be limited to four but may be three (3) or less, or five (5) or more. The first roller 91 may rotate by a driving force from a motor (not shown). The motor to drive the first roller 91 may or may not be the same motor as the motor(s) that drives the feed roller 25, the conveyer roller 60, and the ejection roller 62.

The second roller 92 is arranged to correspond to the roller body 912 of the first roller 91. In other words, the second roller 92 may include four (4) second rollers 92, 92, 92, 92, which are arranged to be spaced apart from one another along the widthwise direction 9 to face the roller bodies 912, 912, 912, 912 of the first roller 91, respectively. The quantity of the second rollers 92 may not necessarily be limited to four but may be three (3) or less, or five (5) or more as long as the quantity matches the quantity of the first roller(s) 91.

The second roller 92 is rotatably supported by the roller holder 87, which will be described further below. The second roller 92 may move alongside a pivoting movement of the roller holder 87. The second roller 92 moved alongside the roller holder 87 may contact or separate from the first roller 91. The second roller 92 may contact directly the first roller 91 or indirectly through the sheet. The second roller 92 contacting the first roller 91 directly or indirectly through the sheet may be rotated by the rotation of the first roller 91.

Roller Holder 87

As shown in FIG. 5, the roller holder 87 is located at an upper position with respect to the upper end of the guide member 71 that corresponds to the feeder tray 131 and at a lower position with respect to the upper end of the guide member 71 that corresponds to the feeder tray 132.

The roller holder 87 includes a guide surface 871, which forms a part of the conveyer path 65. The guide surface 871 extends upper-rearward from an upper end of the oblique surface 73 of the guide member 71 that corresponds to the feeder tray 131. The guide surface 871 may guide the sheet conveyed along the oblique surface 73 to be further conveyed in the conveying direction 16.

The roller holder 87 may include, for example, four (4) roller holders 87, 87, 87, 87, which are arranged along the widthwise direction 9 extending orthogonally to the conveying direction 16. However, the quantity of the holler holders 87 may not necessarily be limited to four but may be, for example, three (3) or less, or five (5) or more.

Each roller holder 87 supports one of the second rollers 92 rotatably in an upper portion thereof. In other words, the roller holders 87, 87, 87, 87 support the second rollers 92, 92, 92, 92 respectively.

Meanwhile, the roller holders 87 may not necessarily support the second rollers 92 on the one-on-one basis. For example, the roller holder 87 may include three (3) roller holders 87, 87, 87, and one of the three roller holders 87, 87, 87 in the middle in the widthwise direction 9 may hold two (2) of the second rollers 92, 92 among the four (4) second rollers 92, 92, 92, 92 on the inside in the widthwise direction 92, while a rightmost one of the roller holders 87, 87, 87 may support a rightmost one of the second rollers 92, 92, 92, 92, and a leftmost one of the roller holders 87, 87, 87 may support a leftmost one of the second rollers 92, 92, 92, 92. For another example, solely one (1) roller holder 87 may support the four (4) second rollers 92, 92, 92, 92. In the following paragraphs, solely one of the roller holders 87, 87, 87, 87 may be described representatively.

The second roller 92 supported by the roller holder 87 partly protrudes from the guide surface 871 toward the conveyer path 65. The guide surface 871 extends in a range from an upstream position to a downstream position with respect to the second roller 92 in the conveying direction 16. In other words, the roller holder 87 extends downstream beyond the second roller 92 in the conveying direction 16. The guide surface 871 includes a downstream guide surface 874, which extends in the downstream area with respect to the second roller 92 in the conveying direction. A downstream end of the downstream guide surface 874 in the conveying direction is located to be higher than the first roller 91. In other words, the downstream guide surface 874 extends to a downstream position with respect to the first roller 91 in the conveying direction 16.

The roller holder 87 is supported pivotably by the housing 14 to pivot about a shaft 31, which extends in the widthwise direction 9. The housing 14 includes the shaft 31 extending in the widthwise direction 9. Meanwhile, the roller holder 87 includes a bearing 872, which forms a cavity 873 elongated in the widthwise direction, and the shaft 31 is inserted in the cavity 873. Thereby, the bearing 872 may support the shaft 31. The bearing 872 and the shaft 31 are located at a lower position in the roller holder 87 to face opposite, e.g., rearward, from the guide surface 871. Therefore, the bearing 872 and the shaft 31 are located on a side of the roller holder 87 opposite to the guide surface 871 that faces the conveyer path 65. In other words, the bearing 872 and the shaft 31 are located on a side opposite to the conveyer path 65 across the guide surface 871. The bearing 872 and the shaft 31 are located to be lower than the second roller 92, in other words, at an upstream position from the second roller 92 in the conveying direction 16.

A position P1 of the shaft 31 is located to be lower than a position P2 of the upper end of the oblique surface 73 of the guide member 71, in the vertical direction 7.

Figure 6:
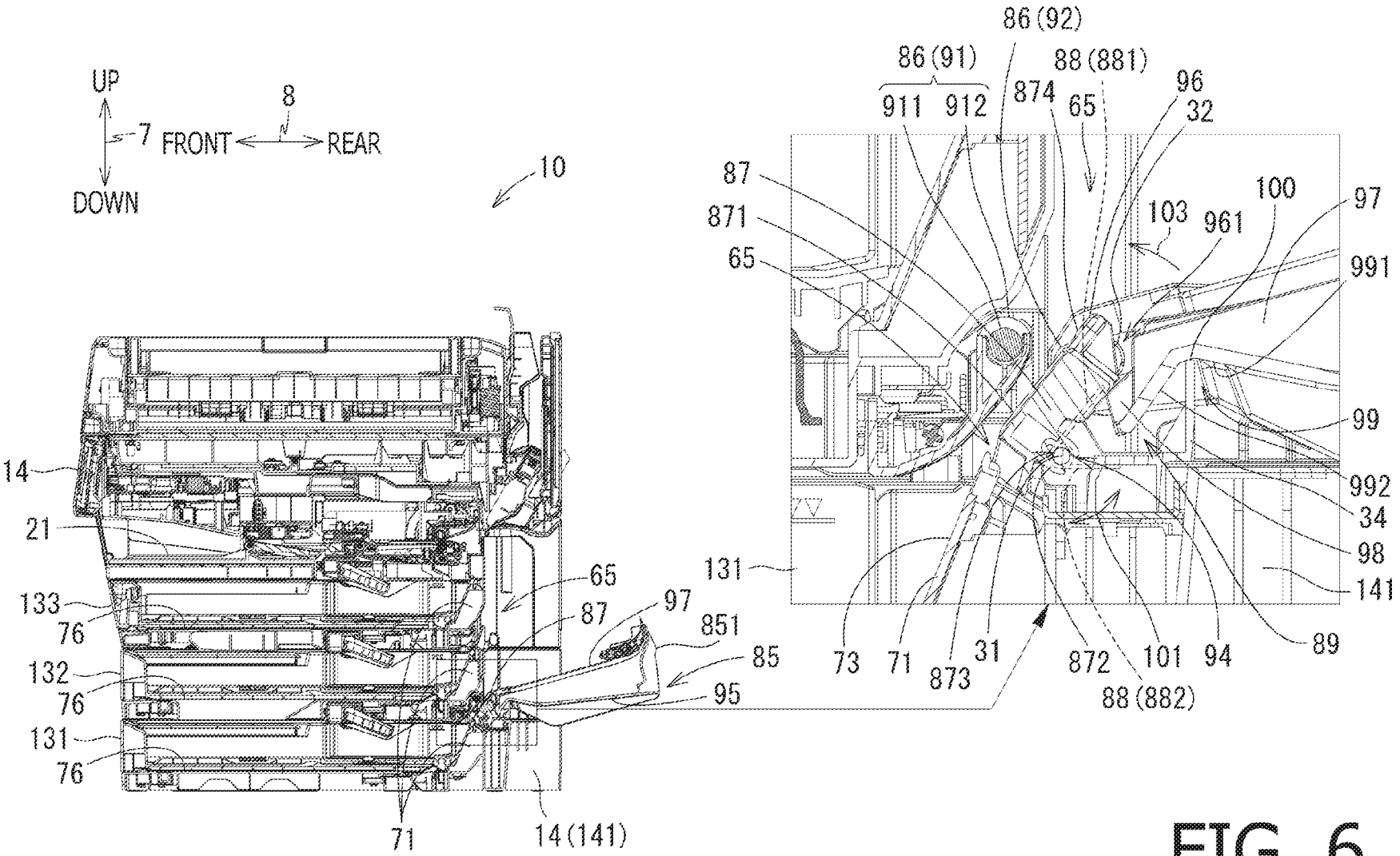
FIG. 6 is a cross-sectional view of the MFP 10 according to the embodiment of the present disclosure viewed at the section C-C shown in FIG. 3 with the roller holder 87 at a second position.

The roller holder 87 may pivot in a direction indicated by an arrow 102 to move from a first position, as shown in FIG. 5, to a second position, as shown in FIG. 6. On the other hand, the roller holder 87 may pivot in a direction indicated by an arrow 103 (see FIG. 6), which is opposite from the direction of the arrow 102, to move from the second position to the first position.

As shown in FIG. 5, when the roller holder 87 is at the first position, the guide surface 871 forms a part of the conveyer path 65. Moreover, when the roller holder 87 is at the first position, the second roller 92 contacts the first roller 91. The second roller 92 contacting the first roller 91 may restrict the roller holder 87 in the first position from pivoting further in the direction of the arrow 103.

As shown in FIG. 6, when the roller holder 87 is at the second position, the second roller 92 is separated from the first roller 91. The roller holder 87 at the second position contacts a second rib 98 in the guide member 85, from an upper-front position. Thereby, the roller holder 87 at the second position may be restricted from pivoting further in the direction of the arrow 102, in other words, in the direction to separate away from the first position. The second rib 98 will be described further below.

The bearing 872 includes an opening 94, at which the bearing 872 is partly absent in a circumferential direction 101. In other words, the bearing 872 is partly open in the circumferential direction 101 through the opening 94. A dimension of the opening 94 in the circumferential direction 101 is smaller than a diameter of the shaft 31. The shaft 31 may enter the bearing 872 through the opening 94. When the shaft 31 passes through the opening 94, the bearing 872 being pushed by the shaft 31 may deform to enlarge the opening 94, and the shaft 91 may be pushed through the enlarged opening 94 and fit in the bearing 872. Once the shaft 31 passes through the opening 94, the bearing 872 may recover to the undeformed shape. Therefore, the shaft 31 may be prevented from falling out from the bearing 872 through the opening 94.

It may be noted that the shaft 31 and the bearing 872 may not necessarily be in the configuration as described above. For example, the roller holder 87 may have the shaft 31 and the housing 14 may have the bearing 872. For another example, the bearing 872 may not necessarily has the opening 94. Without the opening 94, the shaft 31 may be inserted in the bearing 872 along the widthwise direction 9 to fit in the bearing 872.

Torsion Coil Spring 88

The torsion coil spring 88 as shown in FIG. 5 urges the roller holder 87 in a direction as indicated by an arrow 103 (see FIG. 6). In other words, the torsion coil spring 88 urges the roller holder 87 in a direction toward the first position.

The torsion coil spring 88 is coiled around the shaft 31. In other words, the shaft 31 is inserted through the center of the spiral in the torsion coil spring 88. An arm 881 of the torsion coil spring 88 is connected to the roller holder 87, and the other arm 882 of the torsion coil spring 88 is connected to the housing 14.

The roller holder 87 may not necessarily be urged by the torsion coil spring 88 but may be urged alternatively by, for example, a blade spring.

Guide Member 85

As shown in FIG. 2, the guide member 85 is located at a position rearward with respect to the feeder trays 132, 133 and at an upper position with respect to the shaft 31, in other words, at a position downstream from the shaft 31 in the conveying direction 16.

As shown in FIG. 5, the guide member 85 includes a guide body 95, a bearing 96, a first rib 97, and the second rib 98.

Figure 3:
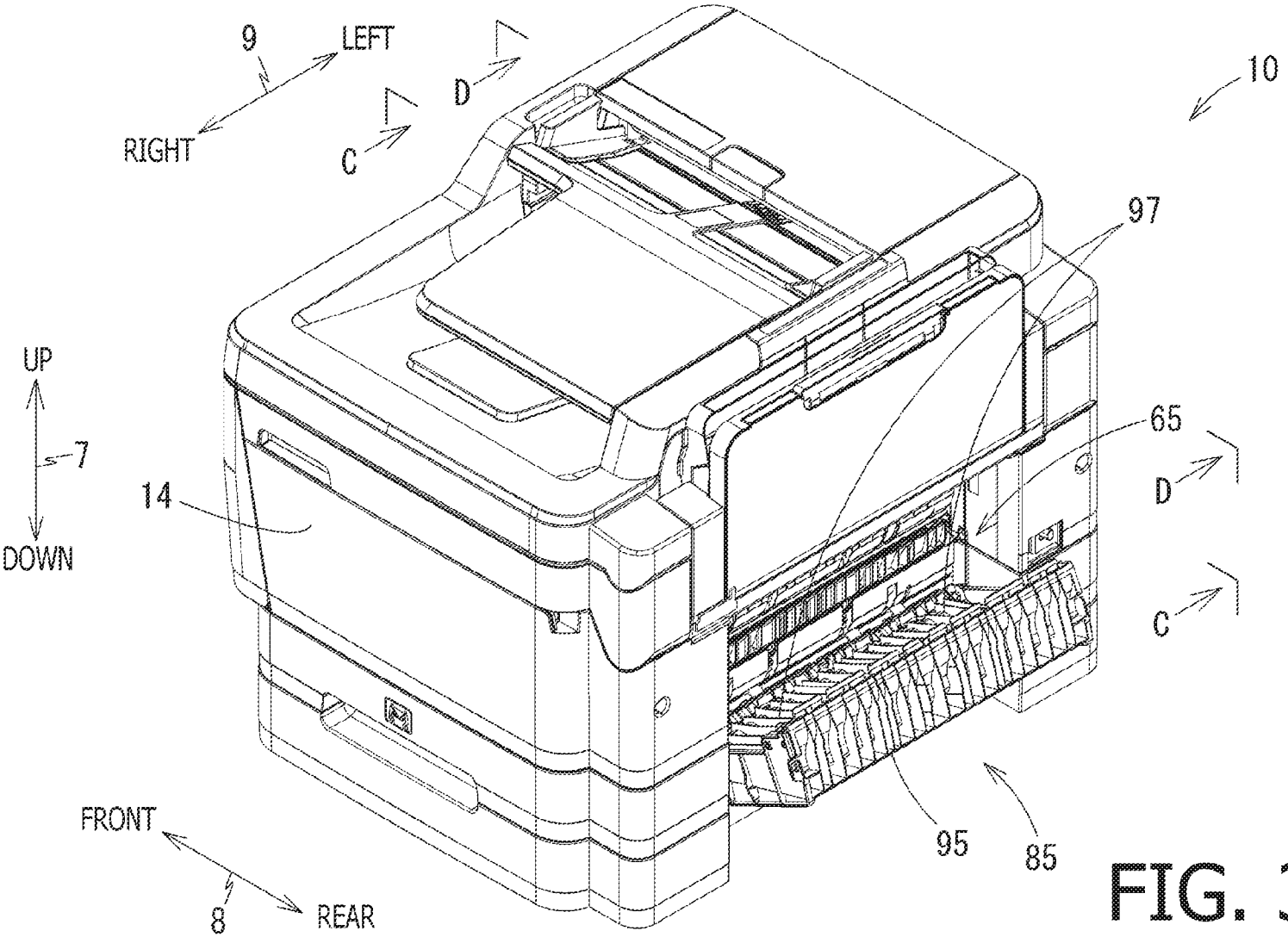
FIG. 3 is a perspective view of the MFP 10 according to the embodiment of the present disclosure with the guide member 85 at an open position.

The guide body 95 has an approximate shape of a plate, as shown in FIG. 3. The guide body 9 includes a bent portion 99 bending upward, in a posture as shown in FIG. 5. The bent portion 99 is formed of two (2) faces 991, 992. In the posture as shown in FIG. 5, the face 991 extends to be higher toward the front, and the face 992 extends to be higher toward the rear. In other words, in the posture as shown in FIG. 5, the face 991 extends to be closer to a shaft 32 toward a peak of the bent portion 99, and the face 992 extends to be farther from the shaft 32 toward the peak of the bent portion 99. The faces 991, 992 are continuous with each other at the peak of the bended portion 99.

The bearing 96 is located at a lower position with respect to the guide body 95, in a posture as shown in FIG. 2, and is open in the widthwise direction 9. An opening 961 is formed in the bearing 96, and the shaft 32 arranged in the housing 14 and extending in the widthwise direction 9 is inserted in the opening 961. Thus, the bearing 96 supports the shaft 32. In other words, the guide member 85 is supported pivotably by the housing 14 through the bearing 96.

Figure 9:
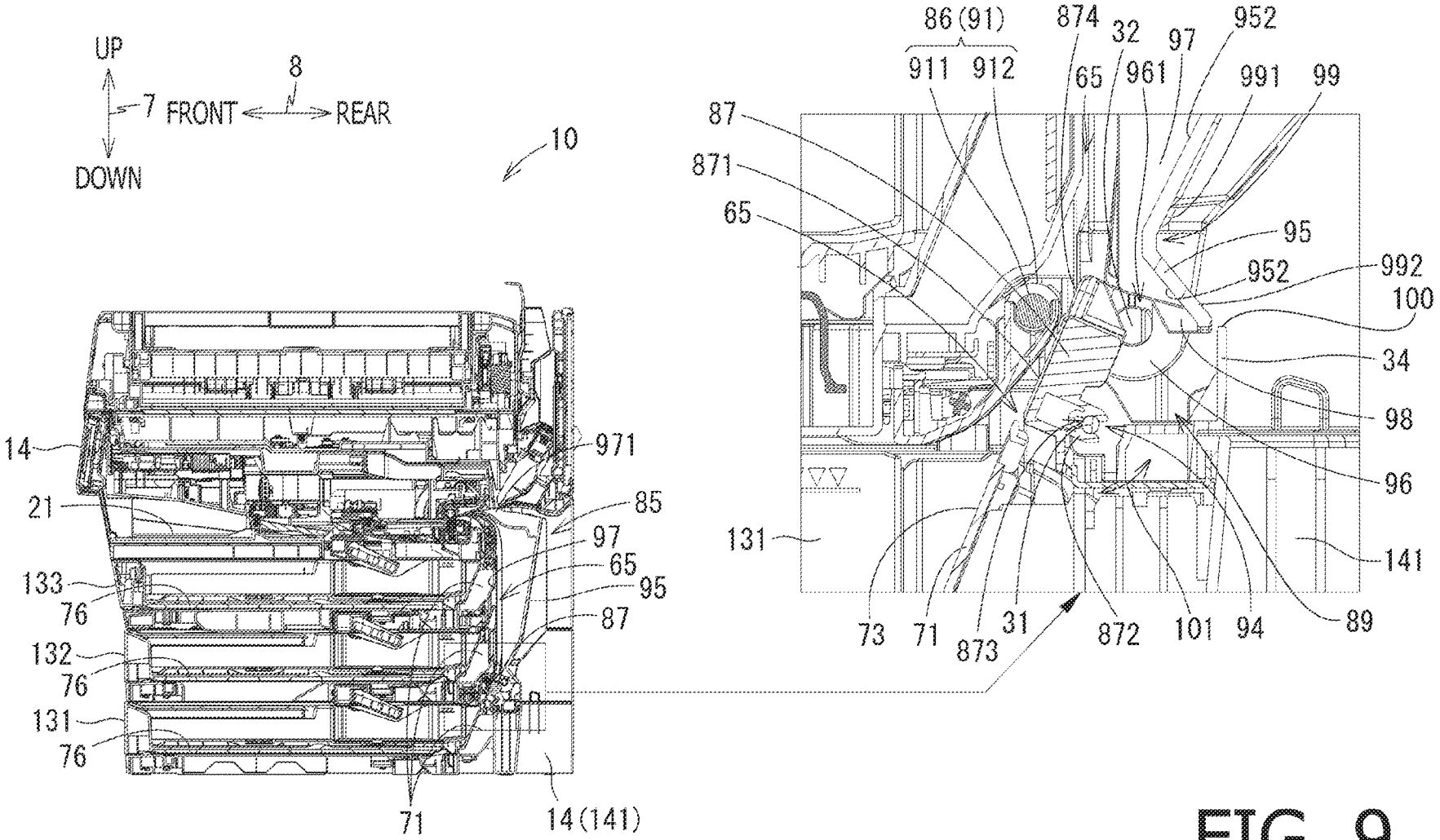
FIG. 9 is a cross-sectional view of the MFP 10 according to the embodiment of the present disclosure viewed at a section E-E shown in FIG. 1.

As shown in FIGS. 5 and 9, the shaft 32 and the bearing 96 are located at a rearward position with respect to the second roller 92. In other words, the shaft 32 and the bearing 96 are located on a side opposite to the first roller 91 across the second roller 92.

The opening 961 in the bearing 96 has an oval shape. Therefore, while the shaft 32 is inserted in the opening 961, the bearing 96 is movable relatively to the shaft 32. In other words, the guide member 85 is slidably supported by the housing 14. In this regard, the guide member 85 is pivotable and slidable to the hosing 14.

The first rib 97 protrudes frontward from a front face 952 of the guide body 95, in a posture as shown in FIG. 9. The first rib 97 includes a plurality of first ribs 97, which are arranged to be spaced apart from one another along the widthwise direction 9. Each first rib 97 extends longitudinally along the conveying direction 16, in other words, substantially vertically. Edges of the first ribs 97 define a part of the conveyer path 65 and may guide a sheet therealong. Edges at downstream end portions 971 of the first ribs 97 curve frontward to change an orientation thereof. Therefore, as mentioned earlier, the conveyer path 65 curves frontward at the upper position with respect to the rearward end of the feeder tray 133. Moreover, the downstream end portions 971 of the first ribs 97 in the conveying direction 61 protrude frontward with respect to the upstream portions of the first ribs 97 in the conveying direction 16.

The second rib 98 protrudes frontward from the front face 952 of the guide body 95, in the posture as shown in FIG. 9. In this regard, the second rib 98 protrudes on the same side of the guide body 95 as the first rib 97. The second rib 98 includes a plurality of second ribs 98, which are arranged to be spaced apart from one another along the widthwise direction 9. As shown in FIG. 6, the second ribs 98 may contact the roller holder 87 located at the second position from a lower position to support the roller holder 87 at the second position and restrict the roller holder 87 at the second position from further rotating in the direction of the arrow 102.

Figure 7:
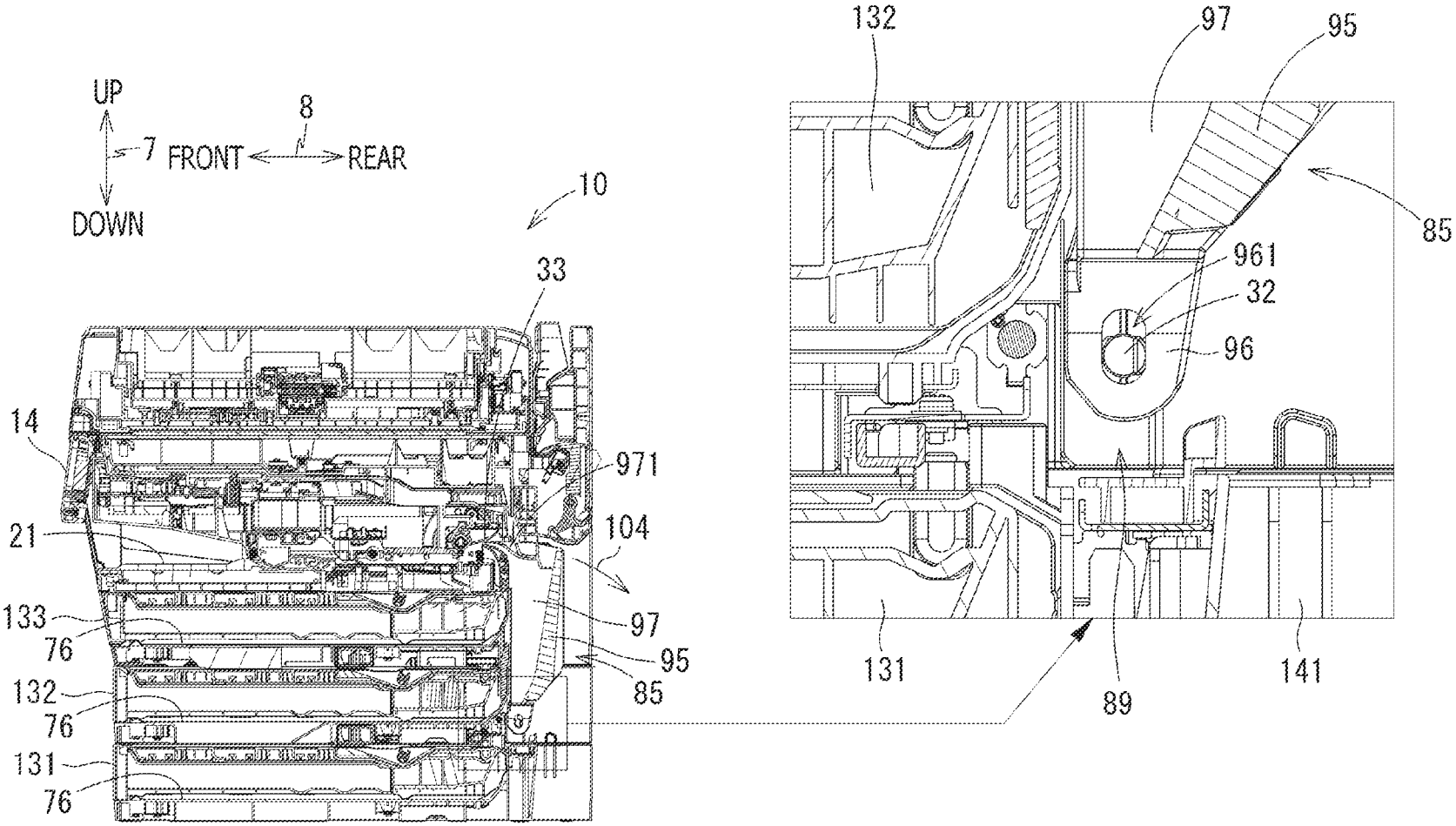
FIG. 7 is a cross-sectional view of the MFP 10 according to the embodiment of the present disclosure viewed at the section A-A shown in FIG. 1.

The guide member 85 is pivotable between the closed position as shown in FIG. 1 and the open position as shown in FIG. 3. The guide member 85 at the closed position is shown in FIGS. 1, 7, and 9, and the guide member 85 at the open position is shown in FIGS. 3, 5, 6, and 8. The guide member 85 may pivot in a direction indicated by an arrow 104 (see FIG. 7) to move from the closed position to the open position. Reversely, the guide member 85 may pivot in a direction indicated by an arrow 105 (see FIG. 8) to move from the open position to the closed position.

When the guide member 85 is at the closed position, as shown in FIGS. 1, 7, and 9, the parts in the guide member 85 may be in conditions as described below.

That is, as shown in FIG. 1, the guide body 95 spreads approximately in the vertical direction 7 and the widthwise direction 9. A rear face 951 of the guide body 95 forms a part of a rear face of the housing 14. In other words, the guide body 95 forms a part of a rear wall of the housing 14. Meanwhile, as shown in FIG. 9, the first ribs 97 are located at a position downstream from the second roller 92 in the conveying direction 16. Moreover, the lower ends of the first ribs 97 are located at a position lower than the upper end of the roller holder 87. In other words, upstream end portions of the first ribs 97 in the conveying direction 16 are located at a position upstream from the downstream end of the roller holder 87 in the conveying direction 16. The edges of the first ribs 97 form a part of the conveyer path 65 and may guide the sheet there-along. The second ribs 98 are located at a position lower than the first ribs 97. In other words, the second ribs 98 are located at a position upstream from the first ribs 97 in the conveying direction 16. Moreover, the second ribs 98 are located at a position rearward with respect to the roller holder 87. In other words, the second ribs 98 are located on a side opposite to the conveyer path 65 across the roller holder 87.

As shown in FIG. 7, when the guide member 85 is at the closed position, the shaft 32 is located in one end area, i.e., a lower end area in FIG. 7, in the opening 961 of the bearing 96. As the guide member 85 pivots from the closed position to the open position, the bearing 96 moves relatively downward to the shaft 32. In other words, the shaft 32 moves relatively to the bearing 96 from the one end area to the other end area, e.g., from the lower end area to an upper end area, in the opening 961 of the bearing 96. Thus, the guide member 85 slides to descend downward. Therefore, as the guide member 85 pivots, the downstream end portion 971 of the first rib 97 in the conveying direction 16 may be prevented from colliding with another parts (e.g., a guide member 33 forming a part of the conveyer 65) located at an upper position with respect to the downstream end portion 971 of the first rib 97. Accordingly, the guide member 85 may rotate without being interfered with by the guide member 33.

When the guide member 85 pivots in the direction of the arrow 104 and reaches the open position, as shown in FIG. 5, a protrusive portion 34 of the housing 14 contacts the peak of the bent portion 99, i.e., a boundary between the face 991 and the face 992, from a lower position. The protrusive portion 34 protrudes upward from a base 151 that forms a lower part of the housing 14. Therefore, the guide member 85 may be restricted from pivoting further in the direction of the arrow 104, i.e., in a direction to separate away from the closed position (see FIG. 7), by the protrusive portion 34. Moreover, sliding movement of the guide member 85 caused by the bearing 96 moving relatively to the shaft 32 may be restricted by the protrusive portion 34.

Figure 8:
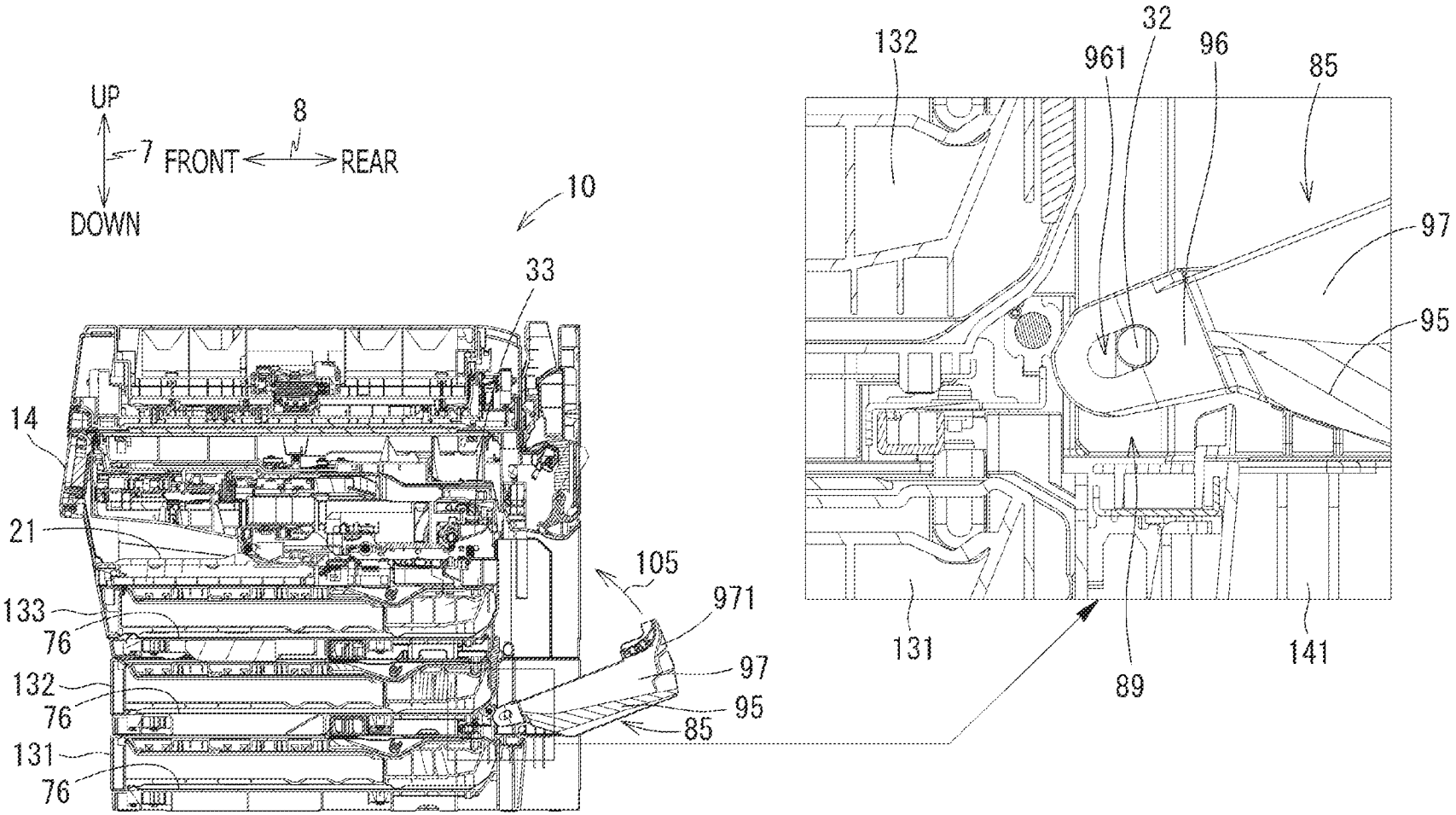
FIG. 8 is a cross-sectional view of the MFP 10 according to the embodiment of the present disclosure viewed at a section D-D shown in FIG. 3.

As shown in Fig. FIG. 8, when the guide member 85 is at the open position, the shaft 32 is in the other end area, e.g., the upper end area, in the opening 961, and the guide member 85 is extended rearward. On the other hand, when the guide member 85 is at the closed position, as mentioned earlier, the guide member 85 is extends in the upright posture, and the shaft 32 is in the one end area, e.g., the lower and area, in the opening 961 of the bearing 96 (see FIG. 7). In this regard, a volume of a part of the guide member 85 that lies in a space 89 when the guide member 85 is at the closed position is smaller than a volume of a part of the guide member 85 that lies in the space 89 when the guide member 85 is at the open position. The space 89 is an area extending rearward from the roller holder 87. In other words, the space 89 is reserved on a side opposite to the first roller 91 across the roller holder 87. Thus, as the guide member 85 at the open position extends rearward, the volume of the part of the guide member 85 occupying the rearward space 89 with respect to the roller holder 87 is larger when the guide member 85 is at the open position than when the guide member 85 is at the closed position.

When the guide member 85 is at the open position, specifically, as shown in FIGS. 3, 5, 6, and 8, the parts in the guide member 85 may be in conditions described below.

That is, as shown in FIGS. 3 and 5, the conveyer path 65 and the roller holder 87 are exposed to the outside. Meanwhile, the protrusive portion 34 contacts the guide member 85 at a contact position 100, which is at a position between the shaft 32 and a rear end 851 of the guide member 85 when the guide ember 85 is at the open position, from a lower position. When the guide member 85 is divided at the contact position 100 into a part, which is closer to the rear end 851 of the guide member 85, and an opposite part, which is farther from the rear end 851 of the guide member 85, the part of the guide member 85 closer to the rear end 851 is heavier than the opposite part of the guide member 85 farther from the rear end 851. As shown in FIG. 6, the second rib 98 may contact the roller holder 87 located at the second position from a lower position in a range on a side opposite to the rear end 851 of the guide 85 across the contact position 100. In other words, the second rib 98 may contact the roller holder 87 located at the second position from below at a position closer to the opening 961 in the bearing 96 than the contact position 100.

Movements of the Guide Member 85 and the Roller Holder 87 in Sheet Jam

When a sheet is jammed at a position in the vicinity of the intermediate roller pair 86, the user may move the guide member 85 to pivot from the closed position (see FIG. 1) to the open position (see FIG. 3). Thereby, the conveyer path 65 with the jammed sheet may be exposed.

If the sheet is not being nipped by the intermediate roller pair 86, the user may pull out and remove the sheet.

On the other hand, if the sheet is being nipped and caught by the intermediate roller pair 86, the user may pull the sheet rearward or upper-rearward. In this instance, a force in the direction of the arrow 102 (see FIG. 5) may be produced by the sheet being pulled and may be applied to the downstream guide surface 874 of the roller holder 87. Therefore, the roller holder 87 may pivot from the first position to the second position against the urging force of the torsion coil spring 88. Accordingly, the second roller 92 may separate from the first roller 91, and the sheet may be removed easily.

Alternately, while the sheet is nipped to be caught by the intermediate roller pair 86, the user may manually move the roller holder 87 to pivot from the first position (see FIG. 5) to the second position (see FIG. 6). For example, the user may press a downstream part of the guide surface 871 from the second roller 92 in the conveying direction 16, i.e., the downstream guide surface 874, in the direction of the arrow 102 so that the roller holder 87 may pivot from the first position to the second position. Thereby, the second roller 92 may separate from the first roller 91, and the sheet may be removed easily.

Once the sheet is removed, and the user releases the roller holder 87, the roller holder 87 may pivot from the second position to the first position by the urging force of the torsion coil spring 88.

Thereafter, the user may pivot the guide member 85 from the open position to the closed position.

Benefits

According to the embodiment described above, by pivoting the guide member 85 from the closed position to the open position, the roller holder 87 may be exposed to the outside. In the present embodiment, pivoting the guide member 85 and pivoting the roller holder 87 may be performed independently. Therefore, when the guide member 85 is moved to pivot, the roller holder 87 may stay at the first position without pivoting. Thus, the roller holder 87 may be restrained from being moved unnecessarily, and the torsion coil spring 88 may be restrained from being fatigued.

According to the present embodiment, the roller holder 87 may be restricted from moving beyond the second position by the contact with the second rib 98 in the guide member 85 located at the open position. In this regard, no additional piece or member to restrict the movement of the roller holder 87, which may otherwise complicate the structure in the MFP 10, is necessary. Therefore, the roller holder 87 may be restricted from moving in the less complicated structure.

According to the present embodiment, the volume of the guide member 85 to occupy the rearward space 89 rearward from the roller holder 87 when the guide member 85 is at the open position is equal to a volume of the guide member 85 to occupy the space 89 when the guide member 85 is at the closed position plus an additional volume of the part of the guide member 85 that extends rearward with respect to the roller holder 87. In this regard, in the space coincident with the additional volume, an item to contact and restrict the roller holder 87 from moving may not be placed. However, according to the present embodiment, without such an additional item that may contact the roller holder 87 to restrict the roller holder 87 from moving, the guide member 85 has the part that may be placed in the space 89 to contact and restrict the roller holder 87 at the second position from moving.

According to the present embodiment, with the shaft 31 movable in the opening 961 in the bearing 96, the guide member 85 may be moved to pivot and slide. Therefore, the guide member 85 may be prevented from being caught by another item, e.g., the guide member 33, when pivots.

According to the embodiment described above, the guide member 85 may be prevented from being moved unintentionally or undesirably while the shaft 32 moves in the opening 961 in the bearing 96.

According to the embodiment described above, the part closer to the rear end 851 of the guide member 85 than the contact position 100 is heavier than the other part farther from the rear end 851 of the guide member 85 than the contact position 100. Meanwhile, the roller holder 87 located at the second position may contact the second rib 98 in the guide member 85 in the range on the side opposite to the rear end 851 of the guide 85 across the contact position 100. Therefore, when the roller holder 87 moved to the second position collides with the second rib 98 in the guide member 85, the guide member 85 may not be moved by the colliding force to pivot easily but may stay stably. In this regard, the guide member 85 may be restrained from being moved to pivot unintentionally.

According to the embodiment described above, the second rib 98 is located on the side opposite to the conveyer path 65 across the roller holder 87. In this regard, when the guide member 85 is at the closed position, the second rib 98 is not located in the conveyer path 65 and may not interfere with the sheet being conveyed.

According to the embodiment described above, the user may reach the downstream guide surface 874, which is the downstream part of the guide surface 871 in the conveying direction 16, to move the roller holder 87 to pivot easily.

According to the embodiment described above, the bearing 872 has the opening 94, through which the shaft 31 is attachable to the bearing 872. Therefore, the roller holder 87 may be easily attached to the housing 14. Moreover, with the shaft 31 closely fitted in the bearing 872, the roller holder 87 may be placed at the correct position easily. Thereby, the nipping accuracy of the second roller 92 with respect to the first roller 91 may be preferably maintained.

According to the embodiment described above, when the sheet is jammed inside the housing 14 in the nipped condition, in which the sheet is caught between the first roller 91 and the second roller 92, by moving the guide member 85 to pivot from the closed position to the open position, the sheet may be exposed. If the sheet in the nipped condition is pulled outward, the force in the direction from the first position toward the second position may be produced by the sheet and applied to the downstream guide surface 874 of the roller holder 87. Therefore, the roller holder 87 may move to pivot from the first position toward the second position. Accordingly, the second roller 92 may separate from the first roller 91, and the sheet may be removed easily.

According to the embodiment described above, when the sheet is jammed inside the housing 14 in the nipped condition, in which the sheet is caught between the first roller 91 and the second roller 92, by moving the guide member 85 to pivot from the closed position to the open position, the sheet may be exposed. When the sheet is pulled outward under this condition, the force in the direction from the first position toward the second position may be produced by the sheet and applied to the downstream guide surface 874 of the roller holder 87. In this occasion, however, if the downstream guide surface 874 was not extended to the downstream position from the first roller 91 in the conveying direction 16, the force to be applied to the downstream guide surface 874 may be reduced, and the roller holder 87 may not be moved substantially to pivot from the first position to the second position. In this regard, according to the present embodiment, the downstream guide surface 874 is extended to the downstream position with respect to the first roller 91 in the conveying direction 16. Therefore, a greater intensity of the force to be applied by the sheet to the downstream guide surface 874 may be reliably produced. Thus, a risk that the roller holder 87 may not substantially move from the first position to the second position when the sheet is pulled outward may be lowered.

According to the embodiment described above, the guide member 85 is located at the position downstream from the shaft 31 in the conveying direction. In this regard, compared to a configuration, in which the guide member 85 is extended to a position upstream from the shaft 31 in the conveying direction, the guide member 85 may be downsized in the vertical direction 7.

According to the embodiment described above, the shaft 31 is located at the position lower than the upper end of the oblique surface 73. In this regard, compared to a configuration, in which the shaft 31 is located at a position higher than the upper end of the oblique surface 73, the shaft 31 may be located at a farther position from the downstream guide surface 874 in the vertical direction 7. Therefore, an intensity of the force to be applied to the downstream guide surface 874, which is required to move the roller holder 87 substantially from the first position toward the second position, may be reduced. In other words, the roller holder 87 may be moved by a less intensive force.

According to the embodiment described above, the roller holder 87 may include a plurality of roller holders 87, which are arranged to be spaced apart from one another along the widthwise direction 9. Therefore, compared a single roller holder 87 elongated in the widthwise direction 9, weight of each roller holder 87 may be reduced, and the roller holders 87 may be moved to pivot by a less intensive force.

According to the embodiment described above, the downstream end of the roller holder 87 in the conveying direction 16 is located at the position downstream from the upstream end of the first rib 97 in the conveying direction 16. In this regard, the sheet may be less likely to be caught between the roller holder 87 and the first rib 97 along the conveying direction 16.

More Examples

Although an examples of carrying out the invention has been described, those skilled in the art will appreciate that there are numerous variations and permutations of the sheet conveyer and the image recording apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the roller holder 87 may not necessarily pivot to move between the first position and the second position but may slide in the front-rear direction 8 to move between a first position and a second position.

For another example, the shape of the opening 961 in the bearing 96 may not necessarily be limited to oval but may be, for example, circular. In other words, the guide member 85 may not necessarily be pivotable and slidable but may be solely pivotably supported by the housing 14.

For another example, the guide member 85 may not necessarily has the first rib 97 that forms a part of the conveyer path 65. In such a case where the first rib 97 is omitted from the guide member 85, for example, a part of the guide body 95 in the guide member 85 that faces toward the conveyer path 65 may form the part of the conveyer path 65.

For another example, the MFP 10 may not necessarily be equipped with the three (3) feeder trays 131, 132, 133 but may be equipped with, for example, a single feeder tray 131, or with two (2), or four (4) or more feeder trays.

For another example, the sheet conveyer may not necessarily be a sheet conveyer to convey the sheets in the MFP 10 but may be a sheet conveyer to convey a sheet in, for example, a scanner that may convey an original sheet with an image to be read by the scanner.

What is claimed is:

1. A sheet conveyer, comprising:

a body comprising a conveyer path, in which a sheet is conveyable;

a first roller located in the conveyer path;

a second roller located to face the first roller;

a roller holder configured to support the second roller rotatably, the roller holder being pivotable about a shaft, the shaft being located at a position different from rollers in the sheet conveyer including the first roller and the second roller;

an urging member configured to urge the roller holder; and a guide member supported rotatably by the body at a position on a side opposite to the first roller across the second roller, the guide member being pivotable between a closed position, in which the guide member forms the conveyer path, and an open position, in which the conveyer path and the roller holder are exposed outward, wherein the roller holder is movable between a first position, in which the second roller contacts the first roller, and a second position, in which the second roller is separated from the first roller and in which the roller holder contacts the guide member located at the open position, the roller holder located at the second position being restricted by the guide member from moving farther from the first position, wherein the urging member is configured to urge the roller holder toward the first position, wherein the roller holder is maintained by an urging force of the urging member to stay at the first position regardless of the position of the guide member, wherein, when the guide member is located at the open position and when the roller holder is located at the first position, the roller holder is movable from the first position against the urging force of the urging member in a direction to separate the second roller from the first roller by a force applied to the roller holder, and wherein, when the roller holder is located at the second position, the roller holder is restricted from moving from the second position farther in the direction to separate the second roller farther from the first roller by a contact with the guide member located at the open position.

2. The sheet conveyer according to claim 1, wherein a volume of a part of the guide member occupying a space reserved in the body on a side opposite to the first roller across the roller holder is smaller when the guide member is located at the closed position than when the guide member is located at the open position.

3. The sheet conveyer according to claim 1, wherein a pivot shaft for the guide member is movable in an oval-shaped bearing that supports the guide member pivotably.

4. The sheet conveyer according to claim 3, wherein the body comprises a contact portion, the contact portion being configured to contact the guide member located at the open position, and wherein the contact portion contacting the guide member located at the open position restricts the bearing from moving relatively to the pivot shaft.

5. The sheet conveyer according to claim 1, wherein the body comprises a contact portion, the contact portion being configured to contact the guide member located at the open position, wherein the contact portion is configured to contact the guide member at a contact position between a pivot shaft for the guide member and an end of the guide member, wherein a part of the guide member between the contact position and the end is heavier than a part of the guide member between the contact position and the pivot shaft, and wherein the guide member is configured to contact the roller holder located at the second position at a position on a side opposite to the end across the contact position.

6. The sheet conveyer according to claim 1, wherein the guide member comprises:

a first rib configured to guide the sheet in a condition where the guide member is located at the closed position; and a second rib configured to contact the roller holder in a condition where the guide member is located at the open position, wherein, in the condition where the guide member is located at the closed position, the first rib is located at a position downstream from the second roller in a conveying direction to convey the sheet, and the second rib is located at a position upstream from the first rib in the conveying direction and on a side opposite to the conveyer path across the roller holder.

7. The sheet conveyer according to claim 1, wherein the roller holder is pivotable to move between the first position and the second position.

8. The sheet conveyer according to claim 7, wherein a pivot shaft for the roller holder is located at a position upstream from the second roller in a conveying direction to convey the sheet, and wherein the roller holder extends to a position downstream from the second roller in the conveying direction.

9. The sheet conveyer according to claim 8, wherein a bearing to support the pivot shaft for the roller holder pivotably comprises an opening, through which the bearing is partly open in a circumferential direction, and wherein the pivot shaft for the roller holder is configured to fit in the bearing through the opening.

10. The sheet conveyer according to claim 1, wherein the guide member located at the closed position forms a part of an exterior wall of the body.

11. The sheet conveyer according to claim 1, wherein the guide member includes a rib, and when the roller holder is located at the second position, the roller holder is restricted from moving from the second position farther in the direction to separate the second roller farther from the first roller by a contact with the rib of the guide member located at the open position.

12. An image recording apparatus, comprising:

a sheet conveyer, the sheet conveyer comprising:

a body comprising a conveyer path, in which a sheet is conveyable;

a first roller located in the conveyer path;

a second roller located to face the first roller;

a roller holder configured to support the second roller rotatably, the roller holder being pivotable about a shaft, the shaft being located at a position different from rollers in the sheet conveyer including the first roller and the second roller;

an urging member configured to urge the roller holder;

a guide member supported rotatably by the body at a position on a side opposite to the first roller across the second roller, the guide member being pivotable between a closed position, in which the guide member forms the conveyer path, and an open position, in which the conveyer path and the roller holder are exposed outward; and a recorder configured to record an image on the sheet being conveyed in the conveyer path, wherein the roller holder is movable between a first position, in which the second roller contacts the first roller, and a second position, in which the second roller is separated from the first roller and in which the roller holder contacts the guide member located at the open position, the roller holder located at the second position being restricted by the guide member from moving farther from the first position, wherein the urging member is configured to urge the roller holder toward the first position, wherein the roller holder is maintained by an urging force of the urging member to stay at the first position regardless of the position of the guide member, wherein, when the guide member is located at the open position and when the roller holder is located at the first position, the roller holder is movable from the first position against the urging force of the urging member in a direction to separate the second roller from the first roller by a force applied to the roller holder, and wherein, when the roller holder is located at the second position, the roller holder is restricted from moving from the second position farther in the direction to separate the second roller farther from the first roller by a contact with the guide member located at the open position.

13. A sheet conveyer, comprising:

a body comprising a conveyer path, in which a sheet is conveyable;

a first roller located in the conveyer path;

a second roller located to face the first roller;

a roller holder configured to support the second roller rotatably, the roller holder being pivotable between a first position, in which the second roller contacts the first roller, and a second position, in which the second roller is separated from the first roller;

an urging member configured to urge the roller holder toward the first position; and a first guide member pivotably supported by the body independently from the roller holder at a position on a side opposite to the first roller across the second roller, the first guide member being pivotable between a closed position, in which the first guide member closes the body and forms a part of the conveyer path, and an open position, in which the first guide member opens the body and exposes the conveyer path and the roller holder outward, wherein the roller holder comprises a guide portion forming another part of the conveyer path at a position downstream from the second roller in a conveying direction to convey the sheet, and wherein the roller holder includes a plurality of roller holders arranged to be spaced apart from one another in a widthwise direction extending orthogonally to the conveying direction.

14. The sheet conveyer according to claim 13, wherein the guide portion extends to a position downstream from the first roller in the conveying direction.

15. The sheet conveyer according to claim 13, wherein the first guide member is located at a position downstream from a pivot shaft for the roller holder in the conveying direction.

16. The sheet conveyer according to claim 13, further comprising:

a tray comprising a supporting surface, the supporting surface being configured to support the sheet;

a feeder configured to feed the sheet supported by the tray in a feeding direction; and a second guide member located at a position downstream from the tray in the feeding direction, the second guide member comprising a guide surface extending to be higher toward downstream in the feeding direction and inclining with respect to the supporting surface, wherein the first roller and the second roller are located at upper positions with respect to the guide surface, wherein the guide surface is configured to guide the sheet being fed by the feeder to guide the sheet toward a position in the conveyer path between the first roller and the second roller, and wherein a pivot shaft for the roller holder is located at a position lower than an upper end of the guide surface.

17. The sheet conveyer according to claim 13, wherein the first guide member includes a plurality of ribs arranged to be spaced apart from one another, the plurality of ribs extending along the conveying direction, the plurality of ribs being configured to guide the sheet in a condition where the first guide member is located at the closed position, and wherein a downstream end of the roller holder in the conveying direction is located at a position downstream from upstream ends of the plurality of ribs in the conveying direction.

18. The sheet conveyer according to claim 13, wherein a bearing to support a pivot shaft for the roller holder pivotably comprises an opening, through which the bearing is partly open in a circumferential direction, and wherein the pivot shaft for the roller holder is configured to fit in the bearing through the opening.

19. The sheet conveyer according to claim 13, wherein the first guide member located at the closed position forms a part of an exterior wall of the body.

20. An image recording apparatus, comprising:

a sheet conveyer, the sheet conveyer comprising:

a body comprising a conveyer path, in which a sheet is conveyable;

a first roller located in the conveyer path;

a second roller located to face the first roller;

a roller holder configured to support the second roller rotatably, the roller holder being pivotable between a first position, in which the second roller contacts the first roller, and a second position, in which the second roller is separated from the first roller;

an urging member configured to urge the roller holder toward the first position;

a guide member pivotably supported by the body independently from the roller holder at a position on a side opposite to the first roller across the second roller, the guide member being pivotable between a closed position, in which the guide member closes the body and forms a part of the conveyer path, and an open position, in which the guide member opens the body and exposes the conveyer path and the roller holder; and a recorder configured to record an image on the sheet being conveyed in the conveyer path, wherein the roller holder comprises a guide portion forming another part of the conveyer path at a position downstream from the second roller in a conveying direction to convey the sheet, and wherein the roller holder includes a plurality of roller holders arranged to be spaced apart from one another in a widthwise direction extending orthogonally to the conveying direction.

21. A sheet conveyer, comprising:

a body comprising a conveyer path, in which a sheet is conveyable;

a first roller located in the conveyer path;

a second roller located to face the first roller;

a roller holder configured to support the second roller rotatably, the roller holder being pivotable between a first position, in which the second roller contacts the first roller, and a second position, in which the second roller is separated from the first roller;

an urging member configured to urge the roller holder toward the first position; and a guide member pivotably supported by the body independently from the roller holder at a position on a side opposite to the first roller across the second roller, the guide member being pivotable between a closed position, in which the guide member closes the body and forms a part of the conveyer path, and an open position, in which the guide member opens the body and exposes the conveyer path and the roller holder outward, wherein the roller holder comprises a guide portion forming another part of the conveyer path at a position downstream from the second roller in a conveying direction to convey the sheet, wherein the guide member includes a plurality of ribs arranged to be spaced apart from one another, the plurality of ribs extending along the conveying direction, the plurality of ribs being configured to guide the sheet in a condition where the guide member is located at the closed position, and wherein a downstream end of the roller holder in the conveying direction is located at a position downstream from upstream ends of the plurality of ribs in the conveying direction.

22. An image recording apparatus, comprising:

a sheet conveyer, the sheet conveyer comprising:

a body comprising a conveyer path, in which a sheet is conveyable;

a first roller located in the conveyer path;

a second roller located to face the first roller;

a roller holder configured to support the second roller rotatably, the roller holder being pivotable between a first position, in which the second roller contacts the first roller, and a second position, in which the second roller is separated from the first roller;

an urging member configured to urge the roller holder toward the first position;

a guide member pivotably supported by the body independently from the roller holder at a position on a side opposite to the first roller across the second roller, the guide member being pivotable between a closed position, in which the guide member closes the body and forms a part of the conveyer path, and an open position, in which the guide member opens the body and exposes the conveyer path and the roller holder; and a recorder configured to record an image on the sheet being conveyed in the conveyer path, wherein the roller holder comprises a guide portion forming another part of the conveyer path at a position downstream from the second roller in a conveying direction to convey the sheet, wherein the guide member includes a plurality of ribs arranged to be spaced apart from one another, the plurality of ribs extending along the conveying direction, the plurality of ribs being configured to guide the sheet in a condition where the guide member is located at the closed position, and wherein a downstream end of the roller holder in the conveying direction is located at a position downstream from upstream ends of the plurality of ribs in the conveying direction.

* * * * *